United States Patent [19]

David et al.

[11] 4,369,918

[45] Jan. 25, 1983

[54] HEAT RETRIEVER APPARATUS

[76] Inventors: Paul E. David, 10433 Sharp Rd., Swartz Creek, Mich. 48473; Leland M. Hyde, 15622 El Paso Dr., Fenton, Mich. 48430

[21] Appl. No.: 152,435

[22] Filed: May 28, 1980

[51] Int. Cl.[3] ..... F24B 7/00

[52] U.S. Cl. ..... 237/55; 122/20 B; 126/101

[58] Field of Search ..... 122/20 B; 165/DIG. 2, 165/DIG. 12; 237/54, 59; 126/101

[56] References Cited

U.S. PATENT DOCUMENTS 528,720 11/1894 Harrison ..... 126/101

3,999,709 12/1976 Estabrook ..... 237/59

4,049,194 9/1977 Tice et al. ..... 126/427

4,210,102 7/1980 Dosmann ..... 126/101

*Primary Examiner*—Albert J. Makay

*Assistant Examiner*—Henry Bennett

[57] ABSTRACT

This device is a box unit, which is attached to the furnace exhaust, between the furnace and chimney. It consists primarily of a unit having, at its top, a reservoir containing fluid. Below the reservoir is an arrangement of tubing, through which the fluid is pumped, and exposed to extremely high temperatures. The unit further consists of a baffle, which causes the heat and exhaust fumes to pass upwards over the tubing, to surround the reservoir, and then downwards, and out of the chimney.

1 Claim, 2 Drawing Figures

HEAT RETRIEVER APPARATUS

This invention relates to heat saving devices, and more particularly, to a heat retriever apparatus.

It is, therefore, the principal object of this invention to provide a heat retriever apparatus, which will be attached to a furnace exhaust, between the furnace and the chimney.

Another object of this invention is to provide a heat retriever device, which will include a heat dissipating radiator, which will be placed inside of the duct work of the house, so as to enable continued use of furnace forced air system.

A further object of this invention is to provide a heat retriever apparatus, which will include tubing means, for the passage of the fluid that is heated, and pumped.

Other objects of the present invention are to provide a heat retriever apparatus, which is simple in design, inexpensive to manufacture, rugged in construction, easy to use and efficient in operation.

These, and other objects, will be readily evident upon a study of the following specification and the accompanying drawing wherein.

Figure 1:
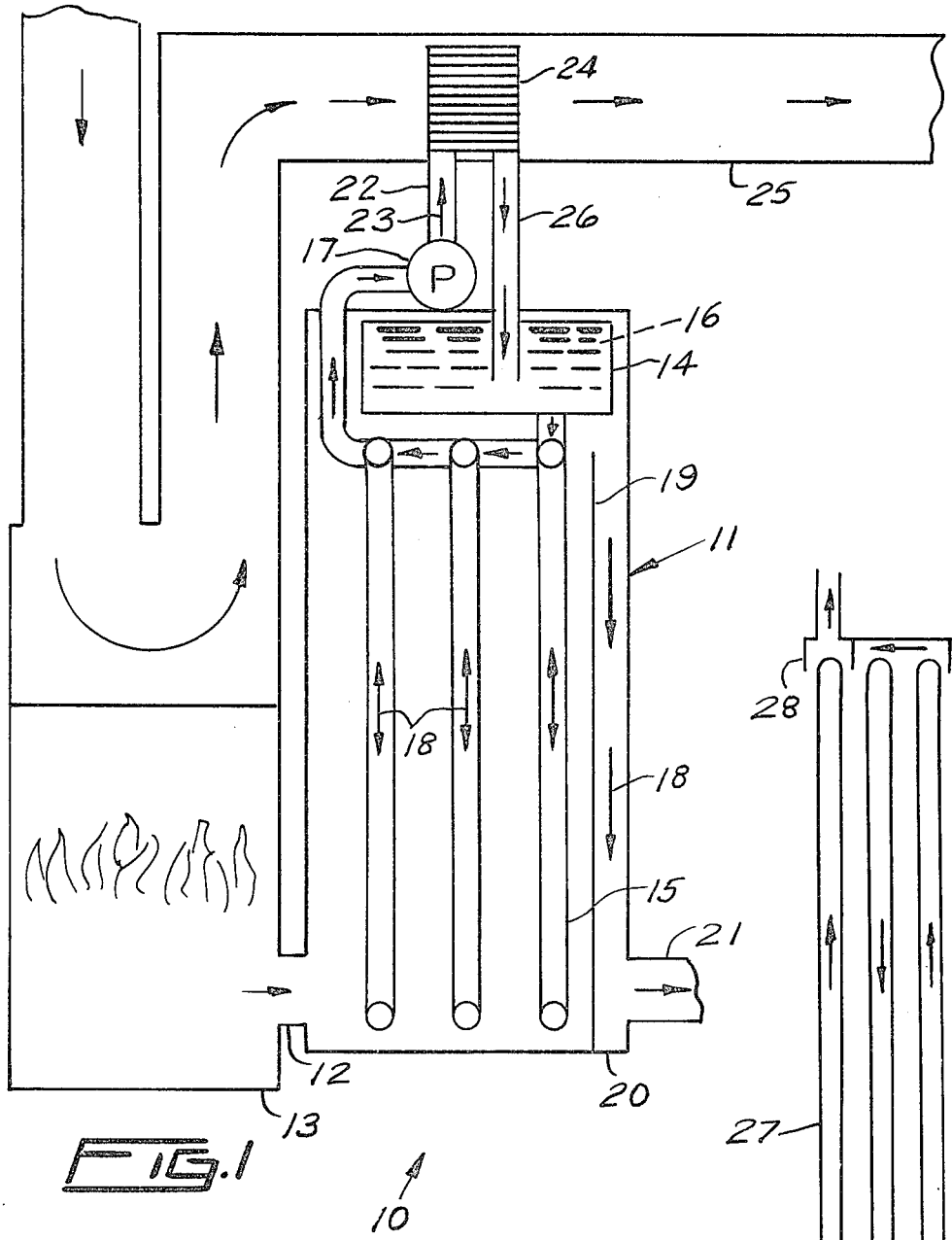
FIG. 1 is a diagrammatic side view of the present invention.

According to this invention, apparatus 10 is shown to include a housing 11, which is attached by pipe, at its lower end, to the lower portion of the gas or oil furnace 13. Inside of housing 11 is a fluid-containing reservoir 14, in the top portion thereof, and, connected thereto, is a plurality of interconnecting tubes 15, through which the fluid 16 circulates by pump 17 means, that is mounted on top of housing 11. The flow of fluid 16 is indicated by the arrows 18, and it shall be noted, that a sheet metal baffle 19 is fixedly secured to the bottom 20 of one side of housing 11, so as to cause the heat and exhaust fumes to pass upwards and over the tubes 15, surround the reservoir 14, and then pass out of the chimney pipe outlet 21. The outlet pipe 22 of pump 17, in which the flow of fluid 16 is indicated by arrow 23, is connected to one side of heat dissipating radiator 24 in duct 25, and the opposite side of radiator 24 is connected, by pipe 26 means, to reservoir 14.

In operation, a volume of fluid 16 is pumped by pump 17, from the reservoir 14, where it has been preheated, through the arrangement of tubes 15, (alternate up and down travel) where final heating is conducted. Upon leaving the tubing 15, the extremely hot fluid 16 travels through the heat dissipating radiator 24, thus returning heat to the house interior. The substantially cooled fluid 16 is then returned to the reservoir 14, so as to repeat the cycle.

Figure 2:
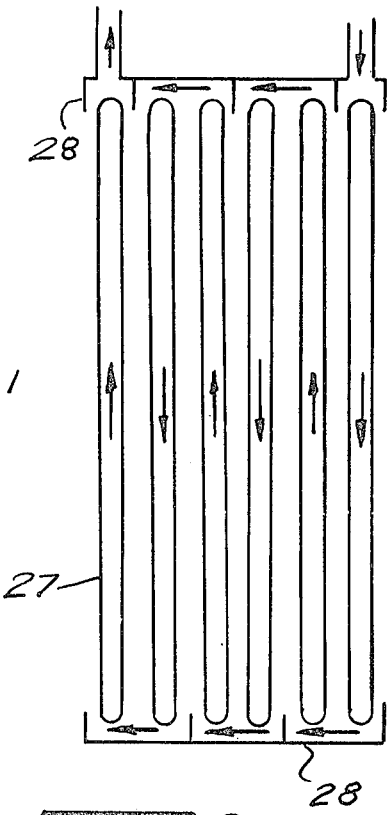
FIG. 2 is a diagrammatic side view of a modified form of tubing arrangement.

Referring now to FIG. 2 of the drawing, a modified form of tubing 27 is shown to include a plurality of baffles 28, which serve as blockages that are intended to route fluid 16 in a controlled manner. When the fluid 16 encounters a "blockage", it will be forced to travel either up or down the next tube. As a further option to the "blockage", a 180 degree, or "U "bent tubing connection can be used, which will be a "serpentive coil".

While various changes may be made in the detail construction, it is understood that such changes will be within the spirit and scope of the present invention, as is defined by the appended claims.

What we now claim is:

1. A heat retriever apparatus, comprising, in combination, an upward housing along a chimney pipe through which smoke and hot exhaust gases travel from the furnace to the chimney of a house, the hot air heating system of said furnace including a hot air duct from a hot air heating chamber above a fire box of said furnace which has a fluid circulating system to heat the air inside said duct further, comprising interconnected pipes inside a compartment of said housing carrying a fluid, heated inside said interconnected pipes by said hot exhaust gases, an outlet of said interconnected pipes extending out the upper end of said housing and being connected through a pump of a heat dissipating radiator inside said hot air duct for said heated fluid, heating said radiator, an outlet of said radiator extending back into said housing and being connected to a closed reservoir that is connected to the inlet of said interconnected pipes for recirculating again; said housing having an inlet and an outlet near the lower end thereof for connection to said chimney pipe, vertical baffle positioned between the interconnected tubes and the housing wall containing the exhaust gas outlet where said baffle extends from the bottom of the housing vertically upward substantially above the housing exhaust gas outlet to form a downward exhaust gas passage to the housing wall exhaust gas outlet.

* * * * *